US007874345B2

(12) United States Patent
Marti et al.

(10) Patent No.: US 7,874,345 B2
(45) Date of Patent: Jan. 25, 2011

(54) APPARATUS FOR THE CONTINUOUS SURFACE CLEANING OF ROTATIONALLY MOVABLE CASTING ROLLS OF A STRIP-CASTING MACHINE

(75) Inventors: Heinrich Marti, Forch (CH); Jacques Barbe, Le Bourg (FR); Philip Eichenberger, Zollikon (CH)

(73) Assignee: Main Management Inspiration AG, Hergiswil (CH)

( * ) Notice: Subject to any disclaimer, the term of this patent is extended or adjusted under 35 U.S.C. 154(b) by 385 days.

(21) Appl. No.: 11/994,582

(22) PCT Filed: Jul. 7, 2006

(86) PCT No.: PCT/EP2006/006724

§ 371 (c)(1),
(2), (4) Date: Feb. 25, 2008

(87) PCT Pub. No.: WO2007/031135

PCT Pub. Date: Mar. 22, 2007

(65) Prior Publication Data

US 2008/0223542 A1 Sep. 18, 2008

(30) Foreign Application Priority Data

Jul. 7, 2005 (CH) ..... 1133/05

(51) Int. Cl.
*B22D 11/06* (2006.01)
*B22D 43/00* (2006.01)

(52) U.S. Cl. ..... 164/428; 164/158

(58) Field of Classification Search ..... 164/158, 164/428, 480

See application file for complete search history.

(56) References Cited

U.S. PATENT DOCUMENTS 4,301,855 A * 11/1981 Suzuki et al. ..... 164/254
4,720,621 A * 1/1988 Langen ..... 219/121.6
4,979,557 A * 12/1990 Honeycutt, III ..... 164/463
5,103,895 A * 4/1992 Furuya et al. ..... 164/475
5,651,413 A * 7/1997 Williams et al. ..... 164/479
6,085,183 A * 7/2000 Horn et al. ..... 706/45

FOREIGN PATENT DOCUMENTS

DE 196 17 387 C1 * 11/1997

* cited by examiner

*Primary Examiner*—Kevin P Kerns
(74) *Attorney, Agent, or Firm*—Brian Roffe

(57) ABSTRACT

An apparatus serves for the continuous surface cleaning of rotationally movable casting rolls (2, 3) of a strip-casting machine. A plurality of laser beam units (25) are arranged on the circumference of the respective casting roll (2, 3), which laser beam units (25) are arranged next to one another, are distributed over the casting-roll length and by means of which the casting-roll surface (2*a*, 3*a*) can be acted upon with one or more laser beams over the entire casting-roll length. Additional cleaning units (30, 31, 35, 45) for the mechanical cleaning of the casting-roll surface are advantageously connected ahead of and/or behind the laser beam units (25). This makes gap-free and regular surface cleaning of the casting rolls possible.

18 Claims, 2 Drawing Sheets

APPARATUS FOR THE CONTINUOUS SURFACE CLEANING OF ROTATIONALLY MOVABLE CASTING ROLLS OF A STRIP-CASTING MACHINE

FIELD OF THE INVENTION

The invention concerns an apparatus for continuous surface cleaning of rotationally movable casting rolls of a strip-casting machine.

BACKGROUND OF THE INVENTION

In casting mills containing one or two casting rolls, it is known that liquid steel comes into contact with the cooled surface of the casting rolls, in order to consolidate thereon. Before the rotating casting roll comes into contact again with the liquid steel, it must be continuously cleaned, in order to prevent any accumulation of metal oxides, slag or other contaminants on the casting-roll surface. Mechanical cleaning devices are used for surface cleaning, such as scrapers, brushes or cleaning belts, with which it is difficult to guarantee consistent cleaning over the entire length of the casting roll. This uneven cleaning has a negative effect on the quality of the cast product. To improve cleaning, there is a known method of distributing a plurality of cleaning devices in sequence along the length of the casting roll, but this gives rise to the risk of gaps forming which impair the surface cleaning. The cleaning devices are also objects which may cause scratching or scraping on the casting-roll surface. These tend to form surface defects on the cast strip. In the casting region, gases and splashes escaping through the liquid steel may contaminate the casting roll surfaces during casting.

From U.S. Pat. No. 5,651,413 it is known that the casting-roll surface can be cleaned by means of a particle/sand blasting device. This involves using one or more spray nozzles distributed over the length of the casting roll. The volume of particles and the spray rate reduces towards the exterior of the spray cone, so that the cleaning is irregular. When several spray nozzles are arranged, areas of contact or overlap arise, which can also lead to irregular cleaning. The particle/sand blasting device which, in addition to the nozzle or nozzles, comprises a receiving container for the sand particles, a return for same, a collecting container, a power supply and a pressurised distributor to send the sand particles back to the nozzle, takes up space. There is also additional dust produced by the atomisation of the particles.

OBJECTS AND SUMMARY OF THE INVENTION

The present invention is based on the problem of creating an apparatus of the aforementioned type which enables consistent surface cleaning over the entire casting roll length, and in which the risk of damage or of degradation of the casting roll surface is largely eliminated.

This problem is solved according to the invention by an apparatus for the continuous surface cleaning of rotationally movable casting rolls of a strip-casting machine in which a laser beam unit or a plurality of laser beam units is/are arranged on a circumference of the respective casting roll, and is/are distributed over the casting-roll length by means of which the casting-roll surface is acted upon with one or more laser beams over the entire casting-roll length.

Further preferred embodiments of the apparatus according to the invention form the subject matter of dependent claims.

The apparatus according to the invention, in which a laser beam unit or a plurality of laser beam units are arranged next to one another on the circumference of the respective casting roll, distributed over the casting-roll length, by means of which the casting-roll surface can be acted upon with one or more laser beams over the entire casting-roll length, enables gap-free and regular surface cleaning of the casting rolls, since the laser beams have very clear borders and can be harmonised with each other in such a way that no gaps or overlaps arise. No scratches or scrapes on the casting-roll surface arise. The apparatus can be used throughout the entire casting operation in the maintenance positions or in an external workshop. It is compact and low-maintenance.

BRIEF DESCRIPTION OF THE DRAWINGS

The invention will next be explained in more detail with the aid of the drawings, which show in purely schematic form.

DETAILED DESCRIPTION OF THE INVENTION

Figure 1:
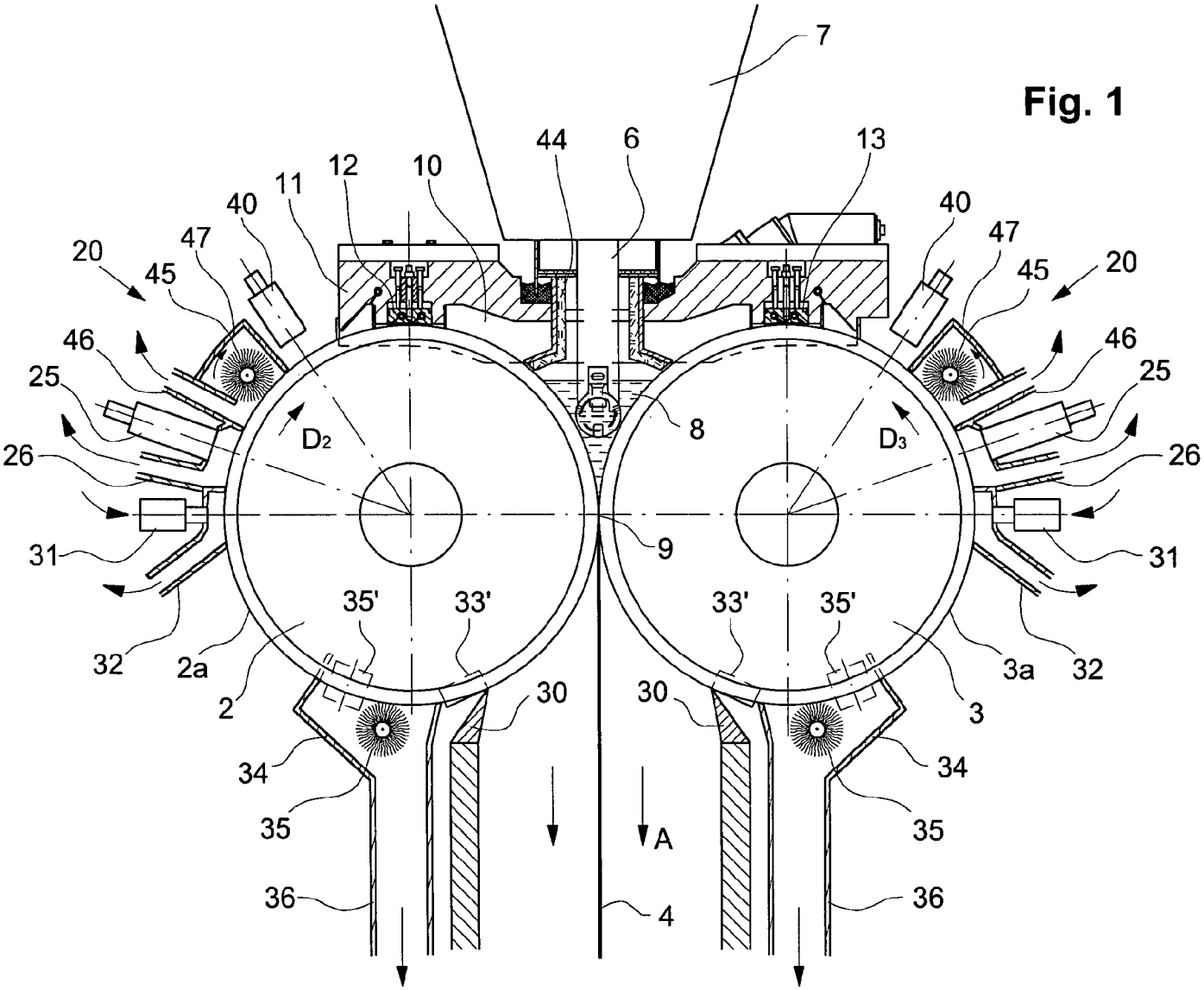
FIG. 1 part of a strip-casting machine 1 with two casting rolls, each with an apparatus according to the invention for the surface cleaning of the casting rolls.
Figure 2:
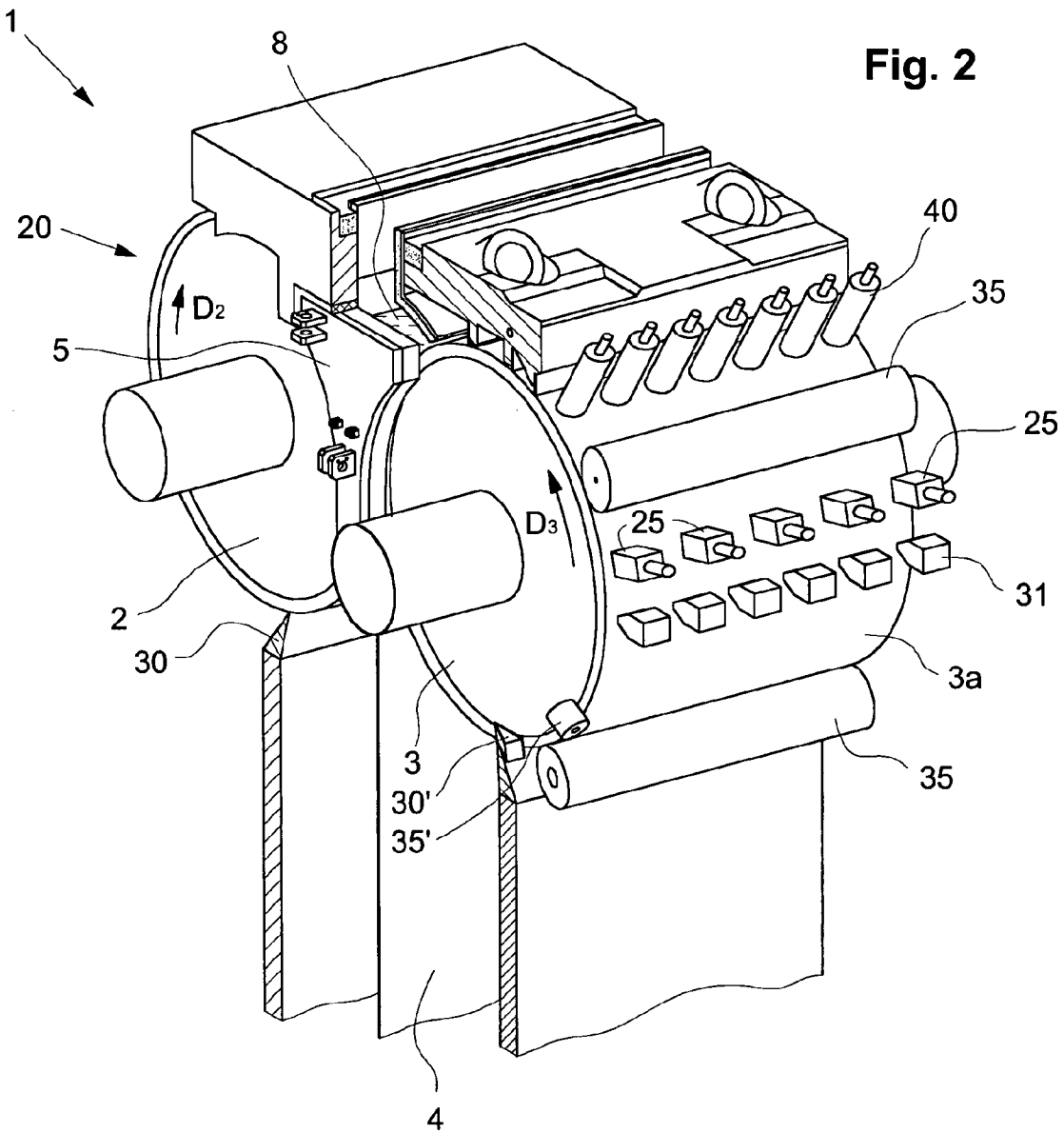
FIG. 2 the strip-casting machine part according to FIG. 1 in perspectival view.

FIGS. 1 and 2 show a part of a strip-casting machine 1 with two casting rolls 2, 3 rotatable about horizontal axes, whose directions of rotation have been given the references $D_2$ and $D_3$ and of which at least one casting roll can be movably adjusted in order to modify the casting gap. To produce a metal strip 4, the liquid metal is poured between the two casting rolls 2, 3 and two lateral sealing elements 5 arranged in the front end area of the casting rolls 2, 3 (cf. FIG. 2, which shows one of the two lateral sealing elements 5) via a pouring device 6 out of a vessel 7 and forms a molten bath 8. The metal strip 4 produced is carried away through a through-gap 9 between the two cooled casting rolls 2, 3 in the direction of arrow A according to FIG. 1.

Above the molten bath 8, a chamber 10 for a protective gas, e.g. argon, is formed. The upper housing part 11 encircling this chamber 10 is equipped with a sealing system 12, 13, co-operating with the respective casting roll 2, 3 and the respective lateral sealing elements 5, and said sealing system separates the chamber 10 from the rest of the interior of the housing of the strip-casting machine 1.

As can be seen in particular from FIG. 1, an apparatus 20 for surface cleaning according to the invention is assigned to each of the two casting rolls 2, 3, by means of which the casting-roll surface 2*a* or 3*a* respectively, effecting the solidification of the liquid metal, cooled and rotating, is continuously cleared of metal oxides, slag or other contaminants, before coming into renewed contact with the liquid metal.

According to the invention, surface cleaning is conducted by means of a laser unit 25 arranged on the circumference of the respective casting roll 2, 3 (with one or more laser beams striking the respective casting roll 2, 3 over its entire length) or by means of several laser beam units 25. In the latter variant with several laser beam units 25 these—as FIG. 2 shows—are arranged side by side in one or more rows and distributed over the entire length of the respective casting roll 2, 3. At the same time, care is taken that the laser beams strike the casting-roll surface 2*a*, 3*a* completely and consistently over the entire length. The laser beam units 25 can be arranged fixedly at a distance from the casting roll or movably in the axial direction of the casting rolls 2, 3.

The laser beams can be harmonised with each other in such a way that no gaps or overlaps occur. They work extremely rapidly and generate extremely high local temperatures, so that the contaminants vaporise or are blasted away. No scratches or scrapes arise on the casting-roll surface 2*a*, 3*a*, because the extremely brief and locally-limited effect of the radiation has a very protective action. As the roll surface 2*a*, 3*a* does not absorb the laser beam, unlike the top layer, but reflects it, the cleaning process stops.

Thus there is no interference with the conditions between the casting-roll surfaces 2*a*, 3*a* and the metal melt during the entire casting period due to the cleaning apparatus and so the quality of the cast strip is not affected. The lifetimes of the casting-roll surfaces and the casting rolls cover are extended.

A suction and filter device 26 is provided for the contaminants detached by the laser beam unit and the laser beam units 25 respectively. In order to protect the casting-roll surfaces from contamination by the gases and smoke escaping from the liquid steel, these are carried away together with added inert gas from the chamber 10. To keep splashes away from the casting roll, especially when casting-on, a splash protector 44 is provided.

The laser beam cleaning and/or the removal of oxides can in some circumstances be automatically interrupted: if there are no longer any oxides on the casting-roll surface, the laser beam is reflected and thus the effect on the casting-roll surface is stopped, so that this suffers no damage.

The apparatus 20 according to the invention for surface cleaning of the respective casting roll 2, 3 can, in addition to the laser beam unit or laser beam units 25, also have at least one additional cleaning unit for the mechanical, chemical, galvanic and/or thermal cleaning of the casting-roll surface 2*a*, 3*a*, which can be connected upstream or downstream of the laser beam unit or the laser beam units 25 in the direction of rotation $D_2$, $D_3$ of the casting roll.

So it is advantageous for strippers 30, 33' in FIG. 1 and strippers 30, 30' in FIG. 2 for stripping off the larger contaminants in the direction of rotation $D_2$, $D_3$ of the casting roll 2, 3 to be connected in series with the laser beam unit or the laser beam units 25, said strippers extending over the entire length of the respective casting roll 2, 3 and over the area of the front end adjacent the cover area. These adjoin, on the side facing away from the strip 4, a first brush 35 arranged out of contact with the roll surface 2*a* and additional brushes 35', which are arranged on the front end, and a suction hood 34, 36 surrounding these, through which the dirt particles detached by the brushes 35, 35' are sucked away. In addition, a sand blasting device 31 with a sand suction device and sand recycling device 32 (or a row of such devices 31, cf. FIG. 2) can be connected upstream of the laser beam unit or the laser beam units 25. It would also be possible to use additional brushes or cleaning belts, not shown in the drawing, upstream of the laser beam unit or the laser beam units 25.

A cleaning brush 45 extending over the entire length of the respective casting roll 2, 3 can advantageously be connected downstream of the laser beam unit or the laser beam units 25 in the direction of rotation $D_2$, $D_3$ of the casting roll 2, 3, with which any residues can be completely removed. The cleaning brush 45 is, according to FIG. 1, preferably accommodated in a housing 47, from which the residual particles are removed by means of a suction device 46. A cleaning brush 45 of this type can, however, be substantially softer than ordinary cleaning brushes, and is also used with less pressing force. Cleaning brushes of this type thus also have longer lifetimes and cause no damage to the casting-roll surfaces 2*a*, 3*a*.

A common housing for brushes or cleaning belts and laser units would also be possible, which would simplify the removal and filtration of the detached contaminants. Also, the entire cleaning apparatus 20, for example when changing a casting roll, could be easily e.g. tipped up as a unit.

The condition of the cleaned casting-roll surface 2*a*, 3*a*, the position, the temperature and the profile of the casting roll are monitored, for which a measurement device 40 is provided, which preferably includes a number of sensors arranged side by side or offset and distributed over the length of the casting rolls (cf. in particular FIG. 2).

The apparatus according to the invention for surface cleaning/renewal of casting rolls can be used during the casting operation or during the entire casting period, in maintenance positions or in an external workshop. It is compact and low-maintenance.

The particle blaster and/or laser beam unit or the laser beam units 25, the final cleaning with suction, an inert gas supply and a splash protector form a complete system, which guarantees optimal cleaning of the roll surfaces.

Mechanical cleaning can also be carried out using scrapers or graters. If a particle blaster is used for cleaning, organic, ceramic, metallic particles, plastic particles or dry ice can be used. It is also possible to turn, mill or grind these surfaces.

A chemical or a chemical-mechanical cleaning can also be applied, for example in the form of etching, preferably using a specific acid, or in the form of removal by caustics. There is also cleaning using ultrasound with a liquid carrier medium.

Thermal cleaning is another option. This involves targeted heating of the roll surface to effect a melting or burning-off of surface accumulations, with the melted accumulations being dabbed off or otherwise removed.

The at least one laser beam unit 25 can also be used for renewing the casting-roll surface during or outside operation, for example to create pits (dimples or textures). Such textures could also be produced by other means, such as for example diamonds, needles, compressed air needle scalers or milling rollers. It is also possible to achieve this effect using the aforementioned particle blaster with ceramic particles, plastic particles, metal particles etc.

The cleaning apparatus for cleaning in-line rolling mill rolls can be used individually or as a system, especially where long sequences are involved.

The invention claimed is:

1. Apparatus for continuous surface cleaning of rotationally movable casting rolls of a strip-casting machine, comprising:

a housing part arranged above a gap between the casting rolls;

a laser beam unit or a plurality of laser beam units arranged on a circumference of the respective casting roll lateral to the housing part, the laser beam unit or plurality of laser beam units being distributed over a length of the casting roll by means of which the casting-roll surface is acted upon with one or more laser beams over the entire casting-roll length; and one or more additional cleaning units for mechanical, chemical, galvanic and/or thermal cleaning of the casting roll surface arranged at the circumference of the respective casting roll, the one or more additional cleaning units being connected to the laser beam unit or the plurality of laser beam units upstream in the direction of rotation of the respective casting roll.

2. Apparatus according to claim 1, wherein the laser beam unit or laser beam units is/are arranged fixedly at a distance from the casting roll or movably in the longitudinal direction of the casting roll.

3. Apparatus according to claim 1, wherein the laser beam unit or the laser beam units and the one or more additional cleaning units are equipped with suction and filter devices.

4. Apparatus according to claim 1, further comprising a common housing assigned to the laser beam unit or the laser beam units and the additional cleaning units.

5. Apparatus according to claim 1, wherein the one or more additional cleaning units comprise scrapers and/or brushes for removal of larger contaminants that are connected upstream of the laser beam unit or the laser beam units in the direction of rotation of the respective casting roll on a front and covering area.

6. Apparatus according to claim 1, wherein the one or more additional cleaning units comprise a particle blasting device connected upstream of the laser beam unit or the laser beam units in the direction of rotation of the respective casting roll.

7. Apparatus according to claim 6, wherein the one or more additional cleaning units and/or the laser beam unit or the laser beam units, a final cleaning with suction, an inert gas supply, a splash protector and a gas or smoke extractor which conducts gases and/or smoke out of a chamber form a complete system.

8. Apparatus according to claim 1, further comprising at least one cleaning brush with a suction system for removal of any residues connected downstream of the laser beam unit or the laser beam units in the direction of rotation of the respective casting roll.

9. Apparatus according to claim 1, wherein the laser beam generated by the laser beam unit or the laser beam units is reflected from a cleaned casting roll surface.

10. Apparatus according to claim 1, wherein at least one laser beam unit is also used to renew the casting roll surface during or outside operation.

11. Apparatus according to claim 1, wherein the cleaning devices are used to clean inline rolling mill rolls individually or as a system, in particular where long sequences are involved.

12. Apparatus according to claim 1, wherein a chemical or a chemical-mechanical cleaning is performed by etching.

13. Apparatus according to claim 1, characterised in that thermal cleaning is performed by targeted heating of the roll surface to effect a melting or burning-off of contaminant particles on the roll surface.

14. Apparatus according to claim 1, wherein the at least one laser beam unit is used to create pits in the casting roll surface during or outside operation.

15. Apparatus according to claim 1, wherein a chemical or a chemical-mechanical cleaning is performed by etching with a specific acid.

16. Apparatus according to claim 1, wherein a chemical or a chemical-mechanical cleaning is performed by removal by caustics.

17. Apparatus according to claim 1, wherein a chemical or a chemical-mechanical cleaning is performed by using ultrasound with a liquid carrier medium.

18. Apparatus according to claim 1, further comprising a particle blasting device connected downstream of the laser beam unit or the laser beam units in the direction of rotation of the respective casting roll.

* * * * *